United States Patent [19]

Baucom et al.

[11] 4,270,340

[45] Jun. 2, 1981

[54] ROTATING RING YARN SPINNING OR TWISTING APPARATUS AND METHOD

[75] Inventors: Joe B. Baucom; James E. Donnelly, both of Gastonia, N.C.

[73] Assignee: Spin-O-Magic, Inc., Gastonia, N.C.

[21] Appl. No.: 4,710

[22] Filed: Jan. 19, 1979

[51] Int. Cl.[3] ..... D01H 7/56; D01H 1/24

[52] U.S. Cl. ..... 57/75; 57/78; 57/122; 57/124

[58] Field of Search ..... 57/75, 88, 101, 78, 57/122, 80, 124, 81, 261, 262

[56] References Cited

U.S. PATENT DOCUMENTS

| | | | |
|---|---|---|---|
| 2,932,152 | 4/1960 | Jackson | 57/124 X |
| 3,324,643 | 6/1967 | Kluttz | 57/124 |
| 3,481,131 | 12/1969 | Chilpan | 57/124 |
| 3,494,120 | 2/1970 | Chilpan et al. | 57/75 |
| 3,851,448 | 12/1974 | Sano et al. | 57/75 |
| 4,023,342 | 5/1977 | Schenkel | 57/124 X |
| 4,030,282 | 6/1977 | Spies | 57/124 |
| 4,051,657 | 10/1977 | Spies | 57/124 |
| 4,095,402 | 6/1978 | Yamaguchi | 57/124 |

FOREIGN PATENT DOCUMENTS

| | | |
|---|---|---|
| 2337203 | 2/1975 | Fed. Rep. of Germany . |
| 1038888 | 8/1966 | United Kingdom . |

*Primary Examiner*—John Petrakes

*Attorney, Agent, or Firm*—Richards, Shefte & Pinckney

[57] ABSTRACT

An air-bearing supported, freely rotated spinning or twisting ring carrying a yarn traveler having radical and cylindrical air-bearings and an annular plenum cavity in at least one of the cylindrical air-bearing surfaces for generally open, unencumbered and continuous admission of pressurized air to the air-bearings. The air-bearings communicate through an annularly disposed mutually connecting enlarged air space. Time delay means is provided for reducing the air supply to the air-bearings at a selected predetermined time after de-energizing the power drive of the apparatus. A method of controlling yarn tension during stop-off of the apparatus includes the steps of maintaining air pressure in the air-bearings after de-energizing the power drive to the apparatus, continuing to maintain the air pressure while the apparatus and the freely rotating ring decelerate for a predetermined time period, and reducing the air pressure at the end of the time period so that the ring decelerates more rapidly and stops prior to the remainder of the apparatus.

12 Claims, 3 Drawing Figures

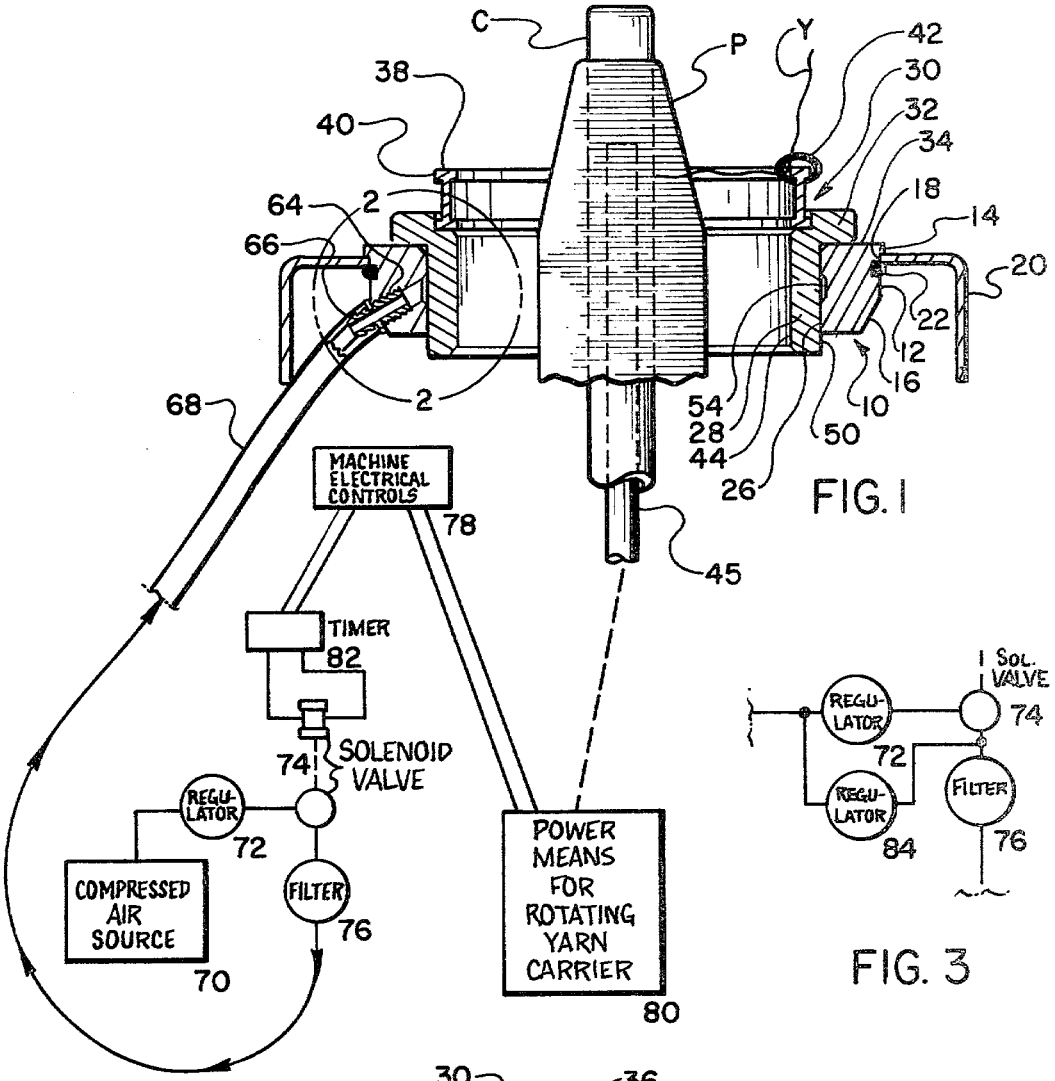
FIG. 1
FIG. 3
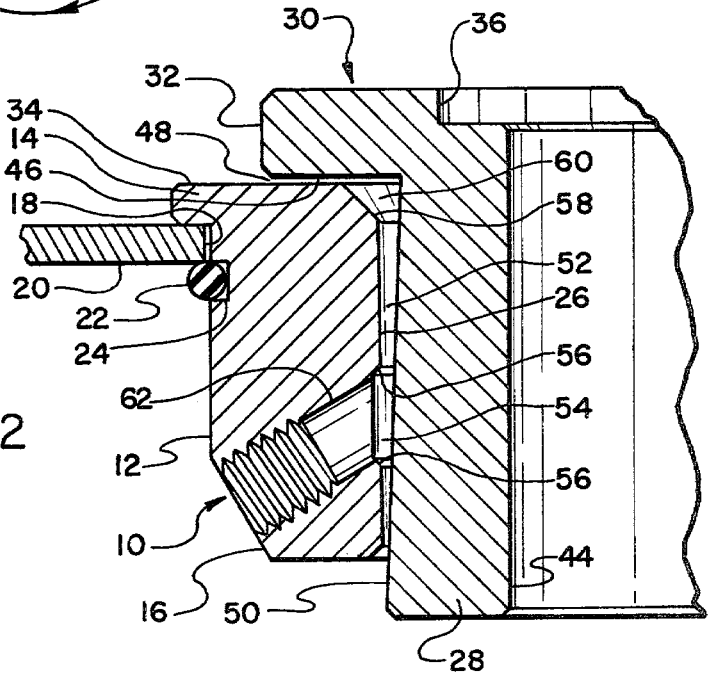
FIG. 2

ROTATING RING YARN SPINNING OR TWISTING APPARATUS AND METHOD

BACKGROUND OF THE INVENTION

A freely rotatable spinning ring having air-bearings for generally friction-free support thereof may be rotated by the frictional drag of a yarn traveler mounted on the ring as yarn is simultaneously twisted or spun and wound onto a yarn carrier or bobbin rotating inside the ring. The traveler rotates about the axis of the yarn carrier at a rotational speed only slightly less than that of the yarn carrier, the difference in speeds allowing the yarn fed to the yarn carrier to be wound thereon under generally uniform tension while compensating for differences in the winding-on diameter of the yarn package being built on the yarn carrier.

In conventional stationary spinning ring apparatus a practical limit on production speeds, or critical speed, is reached when the linear speed of the traveler orbiting the stationary ring is in the neighborhood of 5000 feet per minute. Above that speed, the friction of the traveler on the ring becomes so great that frictional heat tends to burn up the traveler, and the friction becomes erratic as well, tending to overstress and break the yarn.

By allowing the ring to rotate freely on very low friction bearings, the frictional force between traveler and ring causes the ring to rotate at a speed generally approximating that of the traveler, so that while the traveler will have some sliding motion on the ring (thereby compensating for short-term variations in winding-on speeds), the average linear sliding speed will be very low, thereby practically eliminating wear between ring and traveler and causing the frictional forces therebetween to be much more even with a resultant reduction in yarn breaks. Also, the yarn carrier can be rotated at much higher speeds, generally limited only by the mechanical capabilities of the bearings and drive for the rotating spindles on which the yarn carrier is mounted.

The advantages of freely rotating spinning rings are well known to those skilled in the art, as are the problems associated therewith, the principal problems being those of (a) achieving a balanced air flow to and within the radial and annularly axial (or cylindrical) air-bearings provided for each ring, and (b) preventing yarn tangling and breaking when the spindle drive is cut-off and spindle and ring are coasting to a stop at undesirable relative deceleration rates.

Prior art air-bearings for spinning rings have included multiple small holes disposed in the bearing walls for distributing air thereto from surrounding air chambers, and in some cases the small holes have been the porosity in sintered metal porous annular elements forming portions of the air-bearing structure. Such small holes tend to become stopped-up periodically or accidentally and may have peculiar non-uniform air distribution tendencies even when open, and these tendencies may be compounded when both cylindrical and radial air-bearings are supplied together by small holes in the cylindrical bearing walls. Where only a few small holes equally spaced around an air bearing are used to admit air (4, 8, and 16 holes are typical of the prior art patents mentioned hereinafter), it is probable that the full area of the air bearing surfaces is not being used efficiently, and that higher air pressure must be used to center and support the rotating ring member by means of the concentrated areas around the small holes where the air pressure is concentrated than if the full air-bearing surfaces were being used efficiently. Also, tiny particles of dirt or trash which inevitably turn up in compressed air systems may enter through the small air inlet holes and be dragged annularly around the air-bearing to jam in the solid bearing surfaces between the holes.

Air-bearing spinning rings in the prior art have had such low friction and high inertial forces that, once rotating, they tend to coast for extended periods of time, generally for longer periods of time than the spindles and yarn carriers of the spinning apparatus, after driving power is cut off. Therefore, the traveler on the rotating ring may rotate faster than the carrier toward the close of such periods of time, causing loss of yarn tension control as the yarn unwinds from the carrier and tangles and breaks.

In some cases, the air supply to the air-bearings of the rotating ring has been cut-off simultaneously with the power drive for the spindles and carriers, and then the ring has tended to decelerate so quickly that the aforementioned 5000 foot per minute critical speed of the traveler relative to the ring is reached before the carrier rotational speed has decelerated sufficiently to preclude such a condition.

U.S. Pat. Nos. 3,324,643, 3,481,131, and 4,023,342 disclose in detail the principles and prior art practices of yarn spinning or twisting with traveler-equipped freely rotating air-bearing spinning rings discussed above; however it is believed that there is no such equipment commercially available in the United States at this time. U.S. Pat. Nos. 950,507, 3,494,120, 3,611,697, 3,664,112, 3,851,448, 4,028,873, 4,030,282, 4,051,657, and 4,095,402 also disclose material useful in understanding the prior art.

On the basis of experiments with a working model, it appears that the present invention provides effective means for providing uniform air distribution within the radial and cylindrical air-bearings, for providing suitably balanced air distribution between the radial and cylindrical bearings, and for causing the rotating ring to decelerate in desired relation to the spindle, carrier, and traveler (upon cutting-off their driving power) to maintain suitable tension in the yarn throughout the deceleration. The means provided by the present invention for overcoming the technical problems and allowing trouble-free operation are so simple and effective that they should permit a practical initial cost and low maintenance costs during production spinning or twisting, thereby assuring commercial success through application of the apparatus to a large number of existing spinning and twisting spindles in the United States. It is believed that production increases in the order of 50% to 100% may be achieved at a cost of 30%, or less, of the cost of new equipment, and a reduction in mill space and operating personnel will also be realized as compared with adding machinery of conventional construction to achieve corresponding production increases.

SUMMARY OF THE INVENTION

The air-bearing supported spinning or twisting ring apparatus of the present invention includes a ring holder formed with an axially extending circular wall portion and a generally radially extending wall portion, and a ring member freely rotatably mounted within the ring holder and having a circular wall portion and a radial wall portion disposed in closely spaced relation to the circular wall and the radial wall, respectively, of the ring holder to form communicating narrow axial and radial spacings therebetween to receive air for rotatably supporting the ring member in the ring holder, thereby forming the air-bearing supported apparatus. At least one of the circular wall portions has an annular plenum cavity disposed in generally open, unencumbered, and substantially continuous communication with the narrow axial spacing. The apparatus includes means for admitting pressurized air to the plenum cavity, and also includes a yarn traveler mounted on the ring member for sliding movement therearound. The apparatus includes a rotatable yarn carrier for receiving yarn thereon, power means for rotating the yarn carrier, and means for selectively de-energizing the power means, engagement of the yarn traveler by the yarn causing sliding rotation of the traveler about the ring member. The means for admitting air to the plenum cavity for supplying air to the air-bearing includes selectively operable means for reducing the flow of air thereto for rotatably supporting the ring member, and control means interconnects the de-energizing means and the air flow reducing means for operation of the air flow reducing means after the de-energizing of the power means. The control means includes selectively adjustable timer means for delaying the operation of the air flow reducing means for a predetermined time after the de-energizing means has been operated to cause the rotating ring member and the rotating yarn carrier to decelerate in predetermined relation to one another whereby suitable tension is maintained in the yarn by the traveler throughout the deceleration.

Preferably the embodiment of the present invention includes an annular mouth portion of the annular plenum cavity which is enlarged by at least one generally radially disposed annular wall portion thereof which is flared outwardly toward the axial spacing between the ring holder and the ring member. The axial and radial annular spacings between the ring holder and the ring member communicate with each other through at least one generally annularly disposed mutually connecting enlargement of the spacings, and the apparatus includes a ring rail for support of the ring holder. The ring rail has an opening therethrough for reception of the ring holder therein, and the ring holder has a generally cylindrical lower portion thereof which has a chamfer on the lower outer edge thereof for facilitating the reception of the holder into the opening and providing a suitable location for the means for admitting pressurized air to the annular plenum cavity. The means for reducing the flow of air to the air-bearing preferably includes cut-off means for stopping the flow of air to the air-bearing means, and alternatively may include means for reducing the flow of air to a point at which the ring member is rotatably supported by the flow of air only at the circular portion of the air-bearing means and not at the radially extending portion thereof.

In the preferred embodiment of the present invention the outwardly flared generally radially disposed annular wall portion of the annular plenum cavity is flared outwardly at an angle of about 15°, and the circular wall portions of the ring holder and the ring member extend in slight angular relation to one another to cause the narrow axial spacing therebetween to increase gradually in axial direction toward the radial spacing between the ring holder and the ring member.

The method of controlling yarn tension during stop-off of a rotating spinning or twisting ring apparatus for twisting textile fibers and winding them as yarn onto a rotating yarn carrier according to the present invention is based upon the spinning ring being freely rotatably supported by an air-bearing supplied with air under pressure, and upon the apparatus including power means for rotating the yarn carrier at a high operational speed while a traveler slidably mounted on the rotating spinning ring engages the yarn and causes the yarn winding onto the carrier to be under suitable tension at the high speed. The method includes the steps of: cutting off the power means to initiate the stop-off while maintaining air pressure in the air-bearing; continuing to maintain the air pressure while allowing the rotating yarn carrier and the rotating spinning ring to decelerate from the high operational speed after the cutting-off for a predetermined time period; and reducing the air pressure in the air-bearing at the end of the time period whereby the rotating spinning ring is caused to decelerate more rapidly relative to the yarn carrier than during the time period and to stop prior to the yarn carrier.

In the preferred method of controlling yarn tension as described above, the aforesaid reducing of the air pressure in the air-bearing includes a reduction to atmospheric air pressure (by cutting off the air being supplied under pressure to the air-bearing), or, alternatively, includes a reduction to another air pressure at which the spinning ring is freely rotatably supported only by the circular portion of the air-bearing and not by the radially extending portion thereof.

BRIEF DESCRIPTION OF THE DRAWINGS

FIG. 1 is a partial cross-sectional view of a ring spinning frame according to the present invention taken endwise of the ring rail at a typical spinning position and including a schematic illustration of the electrical controls, air supply, power driving means, and timer for the air supply;

FIG. 2 is an enlarged partial cross-sectional view of a portion of FIG. 1 indicated by the broken-line circle 2—2 thereof; and FIG. 3 is a broken-out portion of the air supply schematic of FIG. 1 showing an alternative embodiment including an additional regulator.

DESCRIPTION OF THE PREFERRED EMBODIMENTS

The air-bearing supported rotating spinning ring and traveler apparatus of the present invention is suitable for substitution in a conventional stationary ring and traveler spinning frame or machine such as is well known in the textile machinery and manufacturing arts. Therefore, the only parts of the conventional spinning frame shown in the drawings in detail are the conventional ring rail (which typically extends the length of one side of the spinning frame and may have one hundred and fifty or more ring spinning positions disposed therealong), and the conventional spindle (which extends vertically through an opening in the ring rail at each spinning position and is driven at a rotational speed of thousands of revolutions per minute). Conventional electrical controls and power means for the frame are shown schematically, as are a timer and other conventional devices arranged for supply and control of pressurized air to the air-bearings of the invention in a novel manner, and their use with the novel elements of the rotating ring and traveler is described in detail hereinafter.

A ring holder 10 is provided with a cylindrical body 12 and an outwardly extending flange 14 at the upper portion thereof. The lower portion of the body 12 has a chamfer 16 to facilitate insertion thereof into a conventional opening 18 in a conventional ring rail 20 of a textile spinning frame (not shown). The flange 14 of the ring holder 10 rests on the ring rail 20 and is releasably secured in position there by an O-ring 22 fitted into a groove 24 in the body 12 of the holder 10. The ring holder 10 has a generally cylindrical bore or circular wall portion 26 extending generally axially thereof for reception therein of the generally cylindrical body 28 of a rotating ring member 30.

The ring member 30 has a support flange 32 extending radially outwardly therefrom at the upper portion of the body 28 for support by a radially extending wall portion 34 forming the top surface of the ring holder 10. A counterbore 36 is provided at the inner upper portion of the body 28 of the rotating ring member 30 for reception of a conventional spinning ring 38 thereinto in press fit relation whereby the ring 38 is made an essentially permanent part of the ring member 30, forming the topmost portion thereof and providing a flange 40 for sliding engagement by a conventional ring traveler 42. A cylindrical clearance bore 44 extends through the body 28 of the rotating ring member 30 concentrically therewith allowing space for building a conventional yarn package P on a conventional yarn carrier or bobbin C which is mounted concentrically within the ring member 30 on a conventional rotating spindle 45 of the aforementioned textile spinning frame.

The underside of the flange 32 forms a radially extending wall portion 46 of the ring member 30 which, in operation, is disposed in closely spaced relation to the radially extending wall portion 34 of the ring holder 10 as illustrated in exaggerated fashion in FIG. 2 by the narrow radial spacing 48 shown therebetween as will be explained hereinafter. The circular wall portion 50 forming the outer surface of the cylindrical body 28 is similarly disposed in closely spaced relation to the generally axially extending circular wall portion or bore 26 of the ring holder 10 as illustrated in exaggerated fashion in FIG. 2 by the narrow axial spacing 52 disposed annularly therebetween as will be explained hereinafter. The closely spaced radial and axial wall portions 46, 34 and 50, 26, respectively, together with their respective narrow spacings 48 and 52, form the aforesaid air-bearing when pressurized air is admitted thereto as explained hereinafter.

The circular wall portion 50 of the ring member 30 is tapered slightly outwardly in a direction toward the flange 32 thereof, on the order of 0.0004 inch of diameter per inch of length. The circular wall portion or bore 26 of ring holder 10 should be of untapered cylindrical form, so that the narrow axial spacing 52 increases gradually at the rate of about 0.0002 inch per inch of length toward the narrow radial spacing 48. An annular plenum cavity 54 is disposed intermediately of the length of the bore 26 and has a depth of about 0.030 inch and a width of about 0.125 inch. The narrow axial spacing 52 is about 0.001 inch in the vicinity of the cavity 54, a very small spacing in comparison with the cross-sectional area of the cavity 54. The cavity 54 is formed with generally radially disposed annular wall portions 56 which are each flared outwardly toward the axial spacing 52 at an angle of about 15° (as seen in exaggerated form in FIG. 2).

The bore 26 is chamfered slightly at its lower end for neatness, but a chamfer 58 of about 0.062 inch by 45° is provided at its upper end to form an annularly disposed mutually connecting enlargement 60 of the narrow radial and axial spaces 48 and 52 by which the spaces communicate with each other.

The chamfer 16 at the lower outer edge of the ring holder 10 provides a suitable location for an angularly disposed hole 62 extending therefrom into the annular plenum cavity 54. The hole 62 is threaded at its outer end for reception of a threaded hose fitting 64 preferably having a barbed nipple 66 on one end thereof for reception and retention thereover of a length of plastic tube or hose 68. The angular disposition of the hole 62 is convenient in that it allows the hose 68 to be connected to the ring holder 10 to extend laterally of the ring rail 20 without interference therewith; and it also presents the possibility of using a much larger plastic tube or hose (not shown) having radially disposed holes spaced along one side thereof (at the same spacing as the aforesaid ring spinning positions along the ring rail 20) for reception of a barbed nipple 66 from each ring holder 10 along the ring rail 20, the large tube thereby forming a plenum chamber as well as a means of transmission for supplying pressurized air uniformly to the plenum cavities 54 at each ring spinning position.

A compressed air source 70, which may be the typical textile mill compressed air system, is connected to the tube 68 through suitable conduits (shown schematically in FIG. 1) and through a suitable conventional air pressure regulator 72, solenoid operated on-off valve 74, and air filter 76 (shown schematically in FIG. 1) which form means to selectively supply and cut-off pressurized air to the plenum cavity 54. Conventional machine or spinning frame controls 78 include means for selectively energizing and de-energizing a conventional power means 80 (typically electric-motor-driven) for rotating the spindle 45 and the yarn carrier C thereon. Further controls include a selectively adjustable timer means or time-delay relay 82, such as is well known and may be of electronic or electromechanical or other construction. The timer 82 is electrically interconnected with the controls 78, the power means 80, and the solenoid valve 74 such that upon energization of the power means 80, the solenoid valve 74 is immediately opened to supply pressurized air to the plenum cavity 54; and upon de-energization of the power means 80, a selectively predetermined time period for delaying the operation of the valve 74 is initiated after which the valve 74 is closed to stop the flow of air to the plenum 54. Additional filters or moisture separators or other air treating or control means may be necessary between the air source 70 and the balance of the air circuit, depending upon local conditions.

In operation, upon energization of the power means 80, the spindle 45 will start to rotate, accelerating within seconds to its operational speed of thousands of revolutions per minute, the yarn carrier or bobbin C rotating with it. A strand of textile yarn Y extends from the yarn package P being built on the bobbin C to conventional engagement with the ring traveler 42 and thereabove through a pigtail yarn guide (not shown) as is well known in the art. Rotating the bobbin C causes the yarn Y to pull the traveler 42 around the flange 40 of the spinning ring 38, and sliding friction therebetween tends to rotate the ring 38 and thereby the rotating ring member 30. Energization of the power means 80 having caused the solenoid valve 74 to open and admit pressurized air to the plenum cavity 54 and thereby to the narrow spacings 48 and 52, the rotating ring member 30 is supported by the air for free rotation within the ring holder 10. Thereafter, the relatively low frictional force exerted by the traveler 42 on the ring 38 will gradually accelerate the ring member 30 to an operational rotational speed approaching that of the bobbin C, and the traveler 42 will slide around the spinning ring 38 with decreasing relative velocity during that acceleration. During constant speed rotation of the bobbin C after the initial accelerations of the bobbin C and the ring member 30, the rotational speed of the traveler 42 changes according to the diameter of the yarn package P at the location where the yarn Y is being wound on, as is well-known in the art, the traveler on average lagging behind the bobbin just enough to cause the yarn being fed through the pigtail to the bobbin to be wound onto the bobbin at a suitable tension as determined by the particular conditions of yarn weight, yarn strength, yarn package diameter, rotational speed, traveler weight, etc. that have been selected. Any rapid changes of the traveler rotational speed will be accommodated by more or less sliding of the traveler 42 on the rotating spinning ring 38, the rotating ring member 30 having sufficient rotational inertia so that its rotational speed will be changed only relatively slowly in response to changes in the frictional forces exerted by the traveler 42 on the ring 38 due to changes in the traveler rotational speed. In any case, the sliding between the traveler 42 and the ring 38 due to the aforementioned rapid changes in traveler rotational speed should occur at velocities far below the aforementioned critical or limiting sliding speed (e.g. 5000 feet per minute) which is well known in the art and which causes undue yarn breaks and traveler wear, and travelers are expected to last until they are damaged by the yarn cutting into them.

At the moment when the power means 80 is de-energized to stop off the spinning frame, the spindle 45 and bobbin C immediately start to decelerate, as does the traveler 42. It is believed that wind resistance slows the traveler 42 and the ring member 30 generally proportionally to the slowing of the spindle 45 and bobbin C for a period after the power means 80 is de-energized, thereby maintaining suitable tension in the strand of yarn Y. However, if the pressurized air supply to the plenum cavity 54 is maintained constant indefinitely thereafter, a time will be reached when the ring member 30 and the traveler 42 thereon will rotate at a speed too nearly equal to or greater than that of the decelerating bobbin C (due to the extremely low friction characteristics of the air-bearing formed between the rotating ring member 30 and the ring holder 10 and the considerable rotational inertia of the ring member 30) and such relative speeds will cause loss of control over the tension in the yarn strand Y, even to the extent of unwinding the yarn Y from the yarn package P, thereby resulting in tangled or broken yarn.

Therefore, it is important that at some time after the power means 80 is de-energized, but before the aforementioned loss of tension control, the supply of pressurized air to the plenum cavity 54 should be cut-off, so that the rotating ring member 30 will no longer be supported by pressurized air between the radially extending wall portions 34 and 46 and the circular wall portions 26 and 50, and only atmospheric pressure will exist therebetween. The radially extending wall portions 34 and 46 will then come into ordinary sliding frictional contact, resulting in a considerably increased deceleration of the rotating ring member 30 in predetermined relation to the deceleration of the bobbin C, thereby causing the ring member 30 to stop prior to the stopping of the bobbin C, and thereby causing the ring member 30 and the bobbin C to decelerate in predetermined relation to one another from the moment of de-energizing the power means 80 whereby suitable tension is maintained in the yarn Y throughout the deceleration. The time delay period for cutting-off the air supply must be empirically chosen to insure that the air is cut-off before the rotational speed of the bobbin C drops too near to the rotational speed of the rotating ring member 30, and also to insure that the air cut-off occurs after the speed of the bobbin C has dropped below a point where the increased deceleration of the ring member 30 caused thereby could result in the traveler 42 sliding on the spinning ring 38 at a velocity exceeding the aforementioned critical or limiting sliding speed, such as 5000 feet per minute. It is to be understood that the actual critical speed, operational speed, traveler weight and shape, time delay period, and other yarn, bobbin, yarn package, airbearing, spinning frame, and environmental considerations are all so complexly related that the specific dimensions, speeds, and other conditions described herein may apply only to the disclosed embodiment, yet the principle of providing means for cutting off the pressurized air at a selectively predetermined suitable time after de-energization of the power means is important to the satisfactory commercial use of air-bearing supported rotating spinning rings with yarn travelers.

Operationally, provision of the comparatively large annular plenum cavity 54 permits equalization of air pressure all around the cylindrical air-bearing in the narrow axial spacing 52, and the connecting enlargement 60 between the axial spacing 52 and the narrow radial spacing 48 provides in essence another plenum cavity assuring equalization of air pressure all around the radial air-bearing in the narrow radial spacing 48. The enlargement 60 has a comparatively large cross-sectional area in comparison with the spacings 48 and 52 which it connects.

Also, the enlargement 60 seems to prevent the collection of oily moisture at the junction of the spacings 48 and 52 and in the spacing 48 and the consequent drag and slowing down of the free rotation of the ring member 30. Without the enlargement 60, the oily moisture which is typical in textile mill compressed air supplies appeared to collect in the sharp corner between the radially extending wall portion 46 and the circular wall portion 50 and to spread unevenly into the radial spacing 48, causing or allowing air to escape unevenly through the spacing 48 without carrying away the oily moisture. Adding the enlargement 60 cured the problem and allowed the air-bearing to function normally even when the moisture separation equipment of the mill air supply was defective and inoperative.

While the cavity 54 and the enlargement 60 have been disclosed herein as continuous annular air spaces, and these are preferred for ease of manufacture, they might alternatively be formed of discontinuous annularly disposed segments so long as they extend generally evenly and around the circular wall portions 26 and 50 and each is disposed in generally open, unencumbered, and substantially continuous communication with its adjacent narrow spacing or spacings to effectively achieve the aforesaid equalization of air pressure all around the narrow-spacings without the aforementioned disadvantages of a number of small holes for air distribution. Also, the cavity 54 and enlargement 60 might alternatively be included in the rotating ring member 30 rather than in the ring holder 10 as illustrated, and in that case the angularly disposed hole 62 should extend through the circular wall portion 26 of the ring holder 10 directly opposite the alternative cavity in the ring member 30.

The outwardly flared annular wall portions 56 of the cavity 54 appear to assure smooth, uniform air flow from the cavity 54 into the axial spacing 52. The gradual increase of the axial spacing 52 toward the radial spacing 48 aids in balancing air flow from the upper and lower ends of the axial spacing 52 and into the radial spacing 48 and appears to achieve a suitable balance advantageously in comparison with shifting the disposition of the cavity 54 axially along the bore 26. The sizes, shapes, and dispositions of all the above-mentioned elements might be varied in alternative embodiments of the invention without departing therefrom.

The preferred embodiment described in detail herein has performed satisfactorily at selected regulated air pressures varying between about 2 and 20 pounds per square inch, the lower pressures being preferable with due regard to compressed air consumption, and the radial spacing 48 being variable according to the pressure applied. An alternative embodiment, as illustrated in FIG. 3, might include an additional pressure regulator means 84 bypassing the solenoid valve 74, whereby the air flow and pressure supplied to the plenum cavity could be reduced to some predetermined lower flow and pressure at the end of the aforementioned time delay period when the air pressure from the regulator 72 is cut-off, such lower pressure to be selectively predetermined and set on the regulator 84 so as to allow the radially extending wall portions 34 and 46 to come together and slide on each other in frictional contact at atmospheric air pressure for decelerating the rotating ring member 30 while maintaining the narrow axial spacing 52 at the lower flow and pressure to an extent suitable to protect the circular wall portions 26 and 50 from detrimental wear during the deceleration. Wear on the wall portions 34 and 46 is generally of little concern, but wear of even 0.001" on the circular wall portions 26 and 50 would result in a substantial increase in compressed air requirements. Since the ring holder 10 and the rotating ring member 30 are typically machined from brass, it has been found advantageous to apply a thin hard chrome plating layer to the wall portions 46 and 50 thereof in order to have dissimilar metals in bearing contact whenever the narrow spacings 48 and 52 are not maintained by air pressure.

Apparatus embodying the present invention has been experimentally operated on a 4 inch gage Roberts Arrow spinning frame, model of about 1968, operating satisfactorily at spindle speeds up to 16,000 revolutions per minute, spinning 22's cotton count 65% Kodel polyester 35% cotton yarn at 17.48 turns per inch twist. The yarn was spun onto 12 inch length paper tube bobbins to form an approximately two inch diameter yarn package, using Carter Supreme No. 7 travelers on Roberts 2¼ inch spinning rings. Other yarns ranging from 12's to 40's cotton count, such as 50% polyester 50% acrylic, 75% polyester 25% reginned cotton, and 80% polyester 20% silk, have been run experimentally with apparatus embodying the present invention with good results. Specific preferred dimensions of the ring holder 10 and rotating ring member 30 are as follows:

| | |
|---|---|
| Height of ring holder 10: | .565 inches |
| Diameter of bore 26: | 2.6262 + .0005 inches |
| Vertical distance from center of cavity 54 to radially extending wall portion 34: | .300 inches |
| Height of circular wall portion 50: | .700 inches |
| Diameter of circular wall portion 50 at lower end: | 2.6247 + .0006 inches |
| Diameter of support flange 32: | 3.125 inches |
| Height of support flange 32: | .175 inches |
| Diameter of clearance bore 44: | 2.250 inches |
| Diameter of hole 62: | .159 inches |
| Diameter inside flanges of spinning ring 38: | 2.250 inches |

Whereas the above-described spinning frame is conventionally limited in a particular textile mill to operation at 8,000–10,000 rpm on the above-mentioned yarns by the aforesaid critical or limiting traveler sliding speed of about 5,000 feet per minute and by the particular textile mill's standard of 12 ends down per thousand spindle hours, spinning positions equipped with the air-bearing elements of the present invention appear to operate with ends down reduced over 50% at comparable spindle speeds, and satisfactorily at about 16,000 rpm, limited then only by the capabilities of the spindle bearings and the power drive means. Also such air-bearing equipped spinning positions may be decelerated and stopped from that high speed, also without undue yarn breakage or tangling, by reason of the method and means provided by the present invention for time-delayed reduction of air pressure to the air bearing elements disclosed herein which control yarn tension during stop-off by maintaining suitable predetermined relations between the decelerations of the bobbins and the rotating rings during the stop-off. Typically, the spindles coast about ten seconds after de-energization of the power means, and it has been found advantageous to cut-off the air pressure four to seven seconds after power de-energization, thereby causing the rings to stop about one to three seconds before the spindles stop.

The particular embodiment disclosed in full detail herein and illustrated in the drawings has been provided for disclosure purposes only and is not intended to limit the scope of the present invention, which is to be determined by the scope of the appended claims. We claim:

1. An air-bearing supported spinning or twisting ring apparatus comprising a ring holder formed with an axially extending circular wall portion and a generally radially extending wall portion, a ring member freely rotatably mounted within said ring holder and having a circular wall portion and a radial wall portion disposed in closely spaced relation to said circular wall and said radial wall, respectively, of said ring holder to form communicating narrow axial and radial annular spacings therebetween to receive air for rotatably supporting said ring member in said ring holder, thereby forming said air-bearing supported apparatus, at least one of said circular wall portions having an annular plenum cavity disposed in generally open, unencumbered, and substantially continuous communication with said narrow axial spacing, means for admitting pressurized air to said cavity, and a yarn traveler mounted on said ring member for sliding movement therearound.

2. An air-bearing supported spinning or twisting ring apparatus according to claim 1 and characterized further in that said cavity includes an annular mouth portion enlarged by at least one generally radially disposed annular wall portion of said plenum cavity flared outwardly toward said axial spacing.

3. An air-bearing supported spinning or twisting ring apparatus according to claim 2 and characterized further in that said outwardly flared generally radially disposed annular wall portion of said plenum cavity is flared outwardly at an angle of about 15°.

4. An air-bearing supported spinning or twisting ring apparatus according to claim 1 and characterized further in that said axial and radial annular spacings communicate with each other through at least one generally annularly disposed mutually connecting enlargement of said spacings.

5. An air-bearing supported spinning or twisting ring apparatus as defined in claim 1 and characterized further in that said circular wall portions of said ring holder and said ring member extend in slight angular relation to one another to cause said narrow axial spacing therebetween to increase gradually in axial direction toward said radial spacing.

6. An air-bearing supported spinning or twisting ring apparatus according to claim 1 and characterized further by a ring rail for support of said ring holder, said ring rail having an opening therethrough for reception of said ring holder therein, said ring holder having a generally cylindrical lower portion thereof having a chamfer on the lower outer edge thereof for facilitating said reception of said holder into said opening and providing a suitable location for said means for admitting pressurized air to said cavity.

7. An air-bearing supported spinning or twisting ring apparatus comprising a rotatable yarn carrier for receiving yarn thereon, power means for rotating said yarn carrier, means for selectively de-energizing said power means, a freely rotatable ring member disposed around said yarn carrier and having a yarn traveler slidably carried on said ring member for engagement and sliding rotation thereabout by said yarn, air-bearing means for rotatably supporting said ring member, means for supplying air to said air-bearing means for said supporting including selectively operable means for reducing the flow of air to said air-bearing means for said supporting, and control means interconnecting said de-energizing means and said air flow reducing means for operation of said air flow reducing means after said de-energizing of said power means, said control means including selectively adjustable timer means for delaying the operation of said air flow reducing means for a predetermined time after said de-energizing means has been operated to cause said rotating ring member and said rotating yarn carrier to decelerate in predetermined relation to one another whereby suitable tension is maintained in said yarn by said traveler throughout said deceleration.

8. An air-bearing supported spinning or twisting ring apparatus according to claim 7 and characterized further in that said means for reducing the flow of air comprises cutoff means for stopping the flow of air to said air-bearing means for said supporting.

9. An air-bearing supported spinning or twisting ring apparatus according to claim 7 and characterized further by a generally radially extending portion and a generally axially extending circular portion of said air-bearing means and in that said means for reducing the flow of air comprises means for reducing the flow of air for said supporting to a point at which said ring member is rotatably supported by the flow of air only at said circular portion of said air-bearing means and not at said radially extending portion thereof.

10. A method of controlling yarn tension during stop-off of a rotating spinning or twisting ring apparatus for twisting textile fibers and winding them as yarn onto a rotating yarn carrier, the spinning ring being freely rotatably supported by an air-bearing supplied with air under pressure and said apparatus including power means for rotating said yarn carrier at a high operational speed and a traveler slidably mounted on the rotating spinning ring of said apparatus for engaging said yarn and causing said yarn winding onto said carrier to be under suitable tension at said high speed, said method comprising the steps of:

(a) cutting off said power means to initiate said stop-off while maintaining air pressure in the air-bearing of said apparatus;

(b) continuing to maintain said air pressure while allowing said rotating yarn carrier and said rotating spinning ring to decelerate from said high operational speed after said cutting off for a predetermined time period; and (c) reducing said air pressure in the air-bearing at the end of said time period whereby said rotating spinning ring is caused to decelerate more rapidly relative to said yarn carrier than during said time period and to stop prior to said yarn carrier.

11. A method of controlling yarn tension during stop-off of a rotating spinning or twisting ring apparatus according to claim 10 and characterized further in that said reducing said air pressure in the air-bearing comprises a reduction to atmospheric air pressure by cutting off said air being supplied under pressure to said air-bearing.

12. A method of controlling yarn tension during stop-off of a rotating spinning or twisting ring apparatus according to claim 10 and characterized further in that said reducing said air pressure in the air-bearing, the air-bearing having a generally radially extending portion and a generally axially extending circular portion, comprises a reduction to another air pressure at which said spinning ring is freely rotatably supported only by said circular portion of said air-bearing and not by said radially extending portion thereof.

* * * * *